US007148798B2

(12) United States Patent
Chapman

(10) Patent No.: US 7,148,798 B2
(45) Date of Patent: Dec. 12, 2006

(54) GATE CLOSING TIMER FOR SECURITY GATE OVERRIDE SYSTEM

(76) Inventor: James E. Chapman, 3621 Larchmont Square La., Sacramento, CA (US) 95821

( * ) Notice: Subject to any disclaimer, the term of this patent is extended or adjusted under 35 U.S.C. 154(b) by 49 days.

(21) Appl. No.: 10/923,169

(22) Filed: Aug. 20, 2004

(65) Prior Publication Data

US 2006/0038673 A1 Feb. 23, 2006

(51) Int. Cl.
*G08B 23/00* (2006.01)

(52) U.S. Cl. ..... 340/528; 318/16; 49/25; 49/41

(58) Field of Classification Search ..... 340/528; 318/16, 264–267, 283–286; 49/41, 25
See application file for complete search history.

(56) References Cited

U.S. PATENT DOCUMENTS 4,796,011 A * 1/1989 Lemirande et al. ..... 340/686.1
6,091,217 A * 7/2000 Parsadayan ..... 318/285
6,437,527 B1 * 8/2002 Rhodes et al. ..... 318/280
6,469,464 B1 * 10/2002 McCall ..... 318/445
6,611,205 B1 * 8/2003 Guthrie et al. ..... 340/539.1
6,819,071 B1 * 11/2004 Graham et al. ..... 318/442
6,891,479 B1 * 5/2005 Eccleston ..... 340/686.1
2002/0153854 A1 * 10/2002 Reed et al. ..... 318/466

* cited by examiner

*Primary Examiner*—Jeffery Hofsass
*Assistant Examiner*—Hoi C. Lau
(74) *Attorney, Agent, or Firm*—Donald W. Meeker

(57) ABSTRACT

A solid state programmable timer attaches with two wires across the two contacts for the key circuit of the PC board controlling a security gate and two wires to the emergency personnel remote key switch. A timed cycle is activated by an emergency personnel key opening the security gate. When the timed cycle ends the timer causes the closing of the security gate allowing it to resume normal operation without the need for the emergency personnel key. The timer is pre-programmed with the amount of time normally required for an emergency operation.

6 Claims, 2 Drawing Sheets

GATE CLOSING TIMER FOR SECURITY GATE OVERRIDE SYSTEM

BACKGROUND OF THE INVENTION

1. Field of the Invention

The present invention relates to override systems installed in the circuitry of the operator of all security gates for use by emergency personnel, and particularly to a timer installed, at any point, into the override system that may be set for a predetermined amount of time allowing for emergency personnel to finish their work within the secured area and then have the gate automatically close and resume normal operation after the set time.

2. Description of the Prior Art

Security gates are often used to permit access to an industrial and residential enclosed areas. Many of these gates utilize a powered system to open and close the gates. An override system is installed into the circuitry of the operator of all security gates, which only emergency responders (i.e. police, fire department, and ambulances) have the key to initiate the opening of the security gate.

The KNOX-BOX® Rapid Entry System is commonly used and provides non-destructive emergency access to commercial and residential property. More than 7,000 fire departments and government agencies use KNOX key boxes, which allow them to open security gates with no other assistance. The gate remains open until they "un-key" the KNOX lock on their way out. Often times however, due to the nature of emergency services this last step is overlooked. Two primary problems arise when this happens, First and foremost is the safety of the secured property, which is left vulnerable to burglary, arson, theft, vandalism etc. when the gate is left open. Second is the time spent by emergency personnel to return and close the security gate. A timer to close the gate automatically after a set time allotted to carrying out emergency work would eliminate both of these problems by releasing the emergency personnel of the burden of closing the security gate.

Prior art systems have not adequately addressed this problem.

U.S. Pat. No. 5,903,216, issued May 11, 1999 to Sutsos, provides a security structure unlocking system for use by emergency response and authorized personnel, which has a timer adapted to automatically re-lock said movable security structure after said movable security structure has been unlocked for a period of time. The security structure-opening assembly for use in unlocking a locked structure comprises: a radio frequency receiver formed to detect radio frequency signals on a radio frequency; an actuator coupled to the receiver and formed for coupling to one of a security structure lock assembly and an unlocking mechanism for a security structure lock assembly at a position by-passing any authorized user input device; the receiver being responsive to detected signals to actuate the actuator and produce unlocking of the lock assembly. At progressively higher levels of security, the radio signal is analyzed by a private line detector circuit, a digital burst detector circuit and a decoder circuit. A method for providing a security structure-opening system for a locked structure having an authorized user input device comprising the steps of: coupling a radio frequency receiver assembly to a lock assembly for the locked structure at a position by-passing the authorized user input device, the receiver assembly being formed to detect the presence of signals on a radio frequency and formed to be responsive to a detected signal to unlock the lock assembly; and unlocking the lock assembly by transmitting a signal on a radio frequency to the receiver. At progressively higher levels of security, the process includes the steps of analyzing the radio signal by a private line detector circuit, by a digital burst detector circuit and by a decoder circuit.

U.S. Patent Application #20020153854, published Oct. 24, 2002 by Reed, is for a door operator control system and method that includes a timer controlled closing of the door. The operator control system for controlling the operation of an electric motor driven door or gate operator unit has a speed reducing gear drive mechanism and a brake unit for positive braking of the motor output shaft. A programmable microcontroller is operably connected to a motor drive circuit with interlock relays to energize the operator unit drive motor for rotation in opposite directions. The motor drive circuit is interconnected with a motor watchdog circuit to effect motor shutdown if the microcontroller malfunctions. The motor drive circuit is operably connected to a brake release circuit to prevent motor operation unless the electrically operated brake is energized to release braking of an operator output shaft. The microcontroller receives input signals from manually or radio-controlled door open, close and stop switches and from door position limit switches. The microcontroller is connected to a non-volatile memory for storing door mid-stop time delay values, braking rates, a door position limit overrun signal, a door cycle count, door reversals upon receiving an obstruction detector signal and error codes associated with door operator and control system malfunctions. The door may be operated to provide a down position limit overrun, progressive braking and a mid-stop set position by time based signals. The electrically operated brake may be controlled on a variable duty cycle to provide smooth braking action in both directions of movement of the door.

U.S. Patent Application #20030216139, published Nov. 20, 2003 by Olson, shows a system and method for wireless control of remote electronic systems based on timing information. The wireless control system for wireless control of a remote electronic system, which may be used with a security gate control system, includes a wireless control system circuit coupled to a vehicle interior. The circuit includes a transmitter circuit configured to transmit a wireless control signal having control data which will control the remote electronic system, a timing circuit configured to transmit a timing signal, and a control circuit coupled to the transmitter circuit and the timing circuit. The control circuit is configured to receive the timing signal and to command the transmitter circuit to transmit the wireless control signal based on the timing signal.

U.S. Patent Application #20020194786, published Dec. 26, 2002 by Hincher, illustrates an illuminated safety or security gate that has an optional audible alarm device. The gate includes an electrically operated light adapted to illuminate the gate directly, to project a visible signal away from the gate, or both. The gate includes an electrical system having a battery or plug and cord to supply power, controls, and conductors connecting the light, power source, and controls. Optionally, the controls include a programmable timer, a light-sensitive (photo-electric) controller or a motion sensor to control operation of the light, and a manual switch which controls intensity of the light. Additionally, a motion sensor controls both the light and the audible alarm. The various controls may be combined if desired. A remote controller is optionally provided.

U.S. Pat. No. 4,887,205, issued Dec. 12, 1989 to Chou, indicates a system for controlling a gate, which includes a microprocessor that normally automatically recloses a gate after it has been opened in response to a radio or sensor loop signal, and which normally locks the gate against movement when the gate motor is stopped. When an obstruction is sensed in the path of the gate, the automatic reclosing feature and the sensor loops are disabled, the gate drive remains unlocked even though the motor is stopped, and the response of the system to a radio signal is changed to produce alternating opening and closing of the gate on successive radio signals. At all times, the gate drive lock is released before the motor is started and is not engaged until after the gate has come to rest. Field adjustment of the obstruction sensor is avoided by generating an obstruction signal only when the gate speed falls below the operating speed of a gate imposing the largest design load on the motor, and the speed at which an obstruction is sensed is adjustable in discrete increments by digital switches so that the specific load level at which the system sees an obstruction may be selected to fit various conditions.

U.S. Pat. No. 6,091,217, issued Jul. 18, 2000 to Parsadayan, concerns a safety gate operator, which prevents entrapment, and the method of its operation. The automatic gate operator includes an electric drive motor coupled by a drive train to a movable gate, and includes provisions for sensing an actual or impending obstruction or blockage of the movement of the gate by a human, object, or animal, for example. In response to such an actual or impending blocking of the gate's movement, the drive motor is shut off and the gate is braked to a stop. Then the gate is reversed to move a short distance away from the actual or impending blockage or obstruction, and is braked again to a stop. Next, the gate is freed from its connection with the drive motor, allowing manual movement of the gate to allow clearance of the actual or impending blockage or obstruction from the path of the gate. This stop-reverse-stop-release sequence of movements for the gate may release any entrapped person or object, which may have been contacted by the moving gate. Also, after the gate is released for free movement it can be moved manually. This release of the gate allows an entangled person, object, or animal to free themselves, or to be freed by a bystander, for example. The gate operator also includes a control circuit, which senses traffic conditions and responds by incrementing or decrementing a timer, which controls a pause interval of the gate in its fully-opened position.

What is needed is a key activated timing device that automatically closes the security gate, allowing it to resume normal operation, after a predetermined amount of time.

SUMMARY OF THE INVENTION

An object of the present invention is to provide a timed override activated by the key to the KNOX® lock switch that automatically closes the security gate and allows it to resume normal operation after a period of time without the need to use the key to close and lock the gate.

Another object of the present invention is to provide a simple solid state programmable timer that quickly and easily attaches with two wires across the two contacts for the key circuit of the PC board controlling the gate and two wires to the remote key switch so that the timer simply makes and breaks the contact across the contacts but does not provide current to the circuit for minimal interference with the PC board and switches for the gate operation.

One more object of the present invention is to provide a timer which fits inside the box housing the PC board and can be locked inside to prevent tampering or damage from the weather.

In brief, a simple solid state programmable timer attaches with two wires across the two contacts or terminals for the key circuit of the PC board controlling the gate and two wires to the key switch so that the timer simply makes and breaks the contact across the contacts but does not provide current to the circuit for minimal interference with the PC board and switches for the gate operation. The timer is pre-programmed with the amount of time normally required for an emergency operation, which may be provided by the emergency personnel.

When emergency personnel turn the key to open the gate to admit the emergency vehicles in response to an emergency call or alarm, the timer is activated. After the set time, when normally the emergency vehicles would have departed, the timer opens the circuit across the exit contacts to close the gate automatically.

An advantage of the present invention is that it provides a timed override that automatically closes and returns the security gate to normal operation after a period of time without the need to use the key to close and lock the gate.

Another advantage of the present invention is that it provides a timer that quickly and easily attaches to the PC boards currently used by the gate operator manufacturers.

A further advantage of the present invention is that it is solid state only making and breaking a circuit on the PC board, so it does not interfere with the power to the board.

One more advantage of the present invention is that it fits inside the box housing the PC board and can be locked inside to prevent tampering or damage from the weather.

Yet another advantage of the present invention is that there will be no need to replace the "key" presently used by the emergency personnel to operate the KNOX system.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
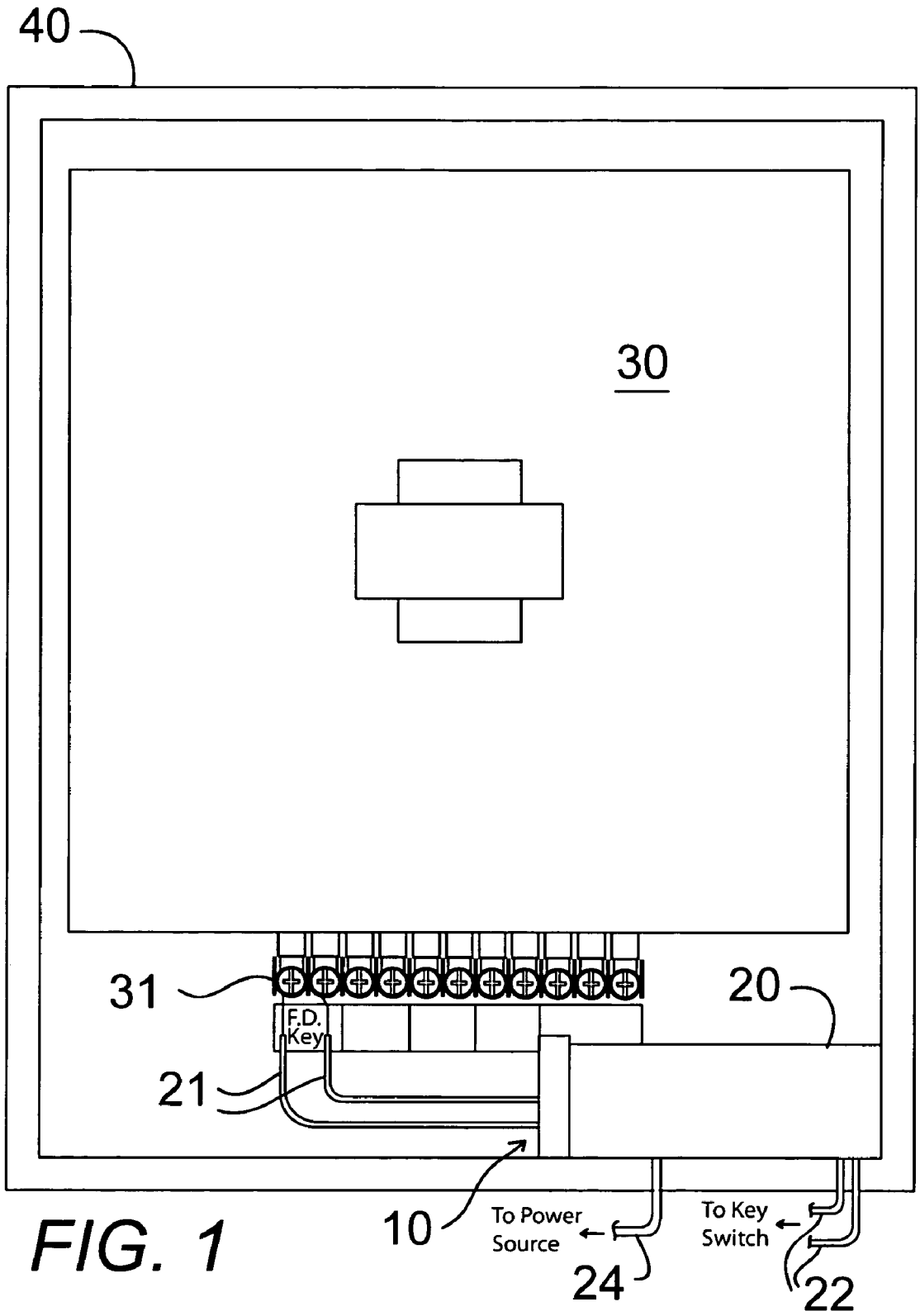
FIG. 1 is a front elevational view of the interior of the lock box with the timer installed and attached to the PC board.
Figure 3:
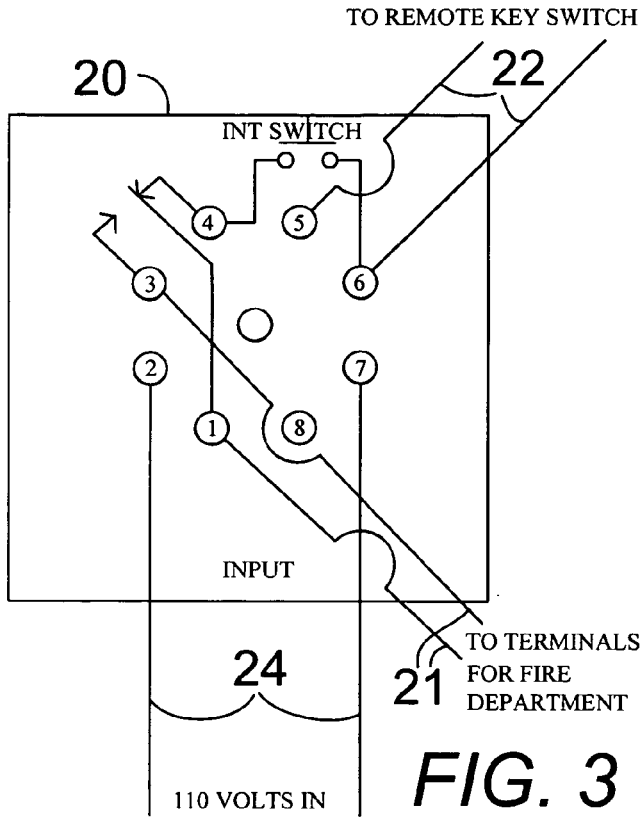
FIG. 3 is a circuit diagram of the connections to the timer.
Figure 2:
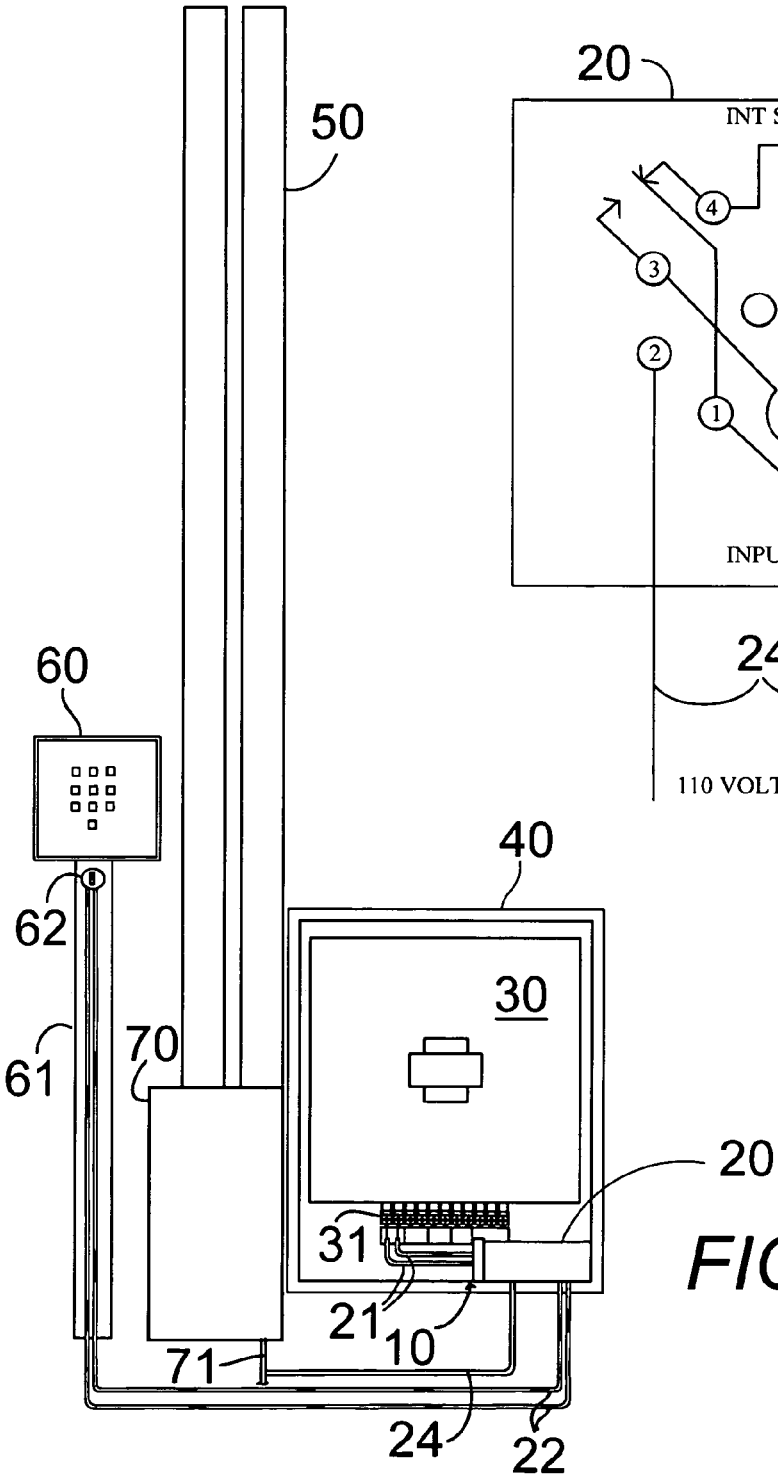
FIG. 2 is a front elevational view of the interior of the lock box with the timer installed and attached to the PC board and showing an end elevational view of the gate, the gate motor and the external keyboard that is normally used to code in a number to open the gate by authorized individuals, such as residents.

In FIGS. 1–3, a timer override device 10 for a lock box 40 on a security gate 50, as seen in FIG. 2, automatically closes a security gate after a set time with the device activated by an emergency personnel key opening the security gate to admit emergency vehicles through the gate.

The timer override device 10 comprises a timer 20 adapted to fit inside the control box 40 for a security gate 50, a first pair of electrical connectors 21, preferably a first pair of electrical wires, from the timer 20 attachable across a pair of terminals designated Fire Department (F.D. Key) for an emergency personnel key circuit on a contact array 31 of a PC board 30 housed in a control box 40 for controlling a security gate 50, the pair of contacts designated Fire Department connect to a circuit for opening the security gate 50, and a second pair of electrical connectors 22, preferably a second pair of electrical wires, from the timer 20 attachable to the remote key switch 62 into which emergency personnel insert their key to open the gate, the key switch 62 on a post 61 supporting the external keyboard 60 normally used to key in a code for authorized users to open the gate 50.

The timer 20 is adapted to start a pre-programmed timed cycle in the timer in response to a turning of an emergency personnel key at the remote key switch 62 and the timer is adapted to open a circuit between the pair of terminals designated Fire Department to close the security gate 50 allowing the device to resume normal operation independently of an emergency personnel key. The timer 20 is adapted to fit within the control box 40 housing the PC board 30 and be locked inside the control box to prevent tampering with the timer.

The timer 20 is preferably a solid state timer and has a power source which is an electrical connector 24 from an AC power source 71 provided for the operation of the security gate 50.

The timer 20 is adapted to open and close a circuit between the terminals designated Fire Department without imparting power from the timer to the terminals.

The timer 20 preferably has a momentary initiate switch with a potentiometer to vary a length of the timed cycle.

All components of the timer device 10 are locked within the control box 40 to protect them from tampering and from the weather.

It is understood that the preceding description is given merely by way of illustration and not in limitation of the invention and that various modifications may be made thereto without departing from the spirit of the invention as claimed.

What is claimed is:

1. A timer override device for a lock box on a security gate for automatically closing a security gate after a preset time with the device activated by an emergency personnel key opening the security gate to admit emergency vehicles through the gate, the device comprising:

a timer adapted to fit inside of a control box for the security gate, the timer comprising a first pair of electrical connectors from the timer attachable across a pair of terminals for an emergency personnel key circuit on a PC board housed in a control box for controlling the security gate, a second pair of electrical connectors from the timer attachable to the remote emergency personnel key switch, the timer adapted to start a pre-programmed timed cycle in the timer in response to a turning of an emergency personnel key in the remote emergency personnel key switch and after a preset time the timer is adapted to open a circuit between the pair of terminals for the emergency personnel key circuit to close the security gate allowing the device to resume normal operation independently of the emergency personnel key, the timer adapted to fit within the control box for the security gate along with the PC board for controlling the security gate, the timer having a power source, the timer adapted to open and close the circuit between the pair of terminals without imparting power from the timer to the terminals.

2. The device of claim 1 when the timer comprises a solid state timer.

3. The device of claim 2 wherein the power source comprises an electrical connector from an AC power source to a motor for operating a security gate.

4. The device of claim 3 wherein the electrical connector is a current conducting electrical wire configuration.

5. The device of claim 2 wherein the timer has a momentary initiate switch with a potentiometer to vary a length of the timed cycle.

6. The device of claim 1 wherein the first and second pairs of electrical connectors are pairs of electrical wires.

* * * * *